US006811106B2

(12) United States Patent
Aikawa

(10) Patent No.: US 6,811,106 B2
(45) Date of Patent: Nov. 2, 2004

(54) REFINER

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 293 days.

(21) Appl. No.: 10/013,667

(22) Filed: Dec. 13, 2001

(65) Prior Publication Data

US 2003/0029587 A1 Feb. 13, 2003

(30) Foreign Application Priority Data

Aug. 8, 2001 (JP) ..... 2001-240412

(51) Int. Cl.[7] ..... B02C 7/14
(52) U.S. Cl. ..... 241/261.1; 241/261.2
(58) Field of Search ..... 162/28; 241/261.1, 241/261.2, 261.3, 296, 297, 298

(56) References Cited

U.S. PATENT DOCUMENTS 1,971,335 A * 8/1934 Benner et al. ..... 241/205
3,788,567 A * 1/1974 Yamada ..... 241/247

* cited by examiner

*Primary Examiner*—Mark Rosenbaum
(74) *Attorney, Agent, or Firm*—Manabu Kanesaka

(57) ABSTRACT

A refiner includes a driving source, a rotating shaft rotated by the driving source, a conical-type rotor attached to the rotating shaft, stators disposed in a casing to face the conical-type rotor. The conical-type rotor has a substantially cone-shape first conical portion and a substantially cone-shape second conical portion, and bottom portions of the first and second conical portions are joined together. The rotating shaft passes through top portions of the first and second conical portions, and the conical-type rotor is attached to the rotating shaft.

5 Claims, 8 Drawing Sheets

REFINER

BACKGROUND OF THE INVENTION AND RELATED ART STATEMENT

The invention relates to a refiner for beating and dissociating pulp, in particular, a refiner having a plurality of conical-type rotors.

Among refiners, such as a disc-type refiner, a conical-type refiner and a drum-type refiner, the conical-type refiner includes a conical-type rotor in a substantially cone-shape, on the surface of which a plurality of bars is provided, and a stator disposed to face the conical-type rotor.

However, in the refiner having the single conical-type rotor as described above, when the pulp is beaten and dissociated through the rotation of the single conical-type rotor, a pressure difference is generated between a material outlet and a portion between the single conical-type rotor and the stator facing the rotor, to thereby allow the space between the single conical-type rotor and the stator to be wider or narrower. Thus, a thrust load is generated in an axial direction of a rotating shaft where the single conical-type rotor is attached.

Therefore, a bearing for holding the rotating shaft of the conical-type rotor must be mechanically formed with a structure coping with the thrust load. Moreover, there has been a problem such that an energy loss due to the thrust load takes place.

In view of the above problems, the present invention has been made and an object of the invention is to provide a refiner to obviate the above problems.

Further objects and advantages of the invention will be apparent from the following description of the invention.

SUMMARY OF THE INVENTION

In order to attain the above-stated objects, according to a first aspect of the invention, a refiner includes a driving source, a rotating shaft rotated by the driving source, a conical-type rotor attached to the rotating shaft, and stators disposed in a casing to face the conical-type rotor. The conical-type rotor has a first conical portion in a substantially cone-shape and a second conical portion in a substantially cone-shape, and a bottom portion of the first conical portion and a bottom portion of the second conical portion are joined together. The rotating shaft passes through top portions of the first conical portion and the second conical portion, and the conical-type rotor is attached to the rotating shaft.

Also, according to a second aspect of the invention, in the refiner according to the first aspect, one end side of the rotating shaft is made free without being supported thereat, and the other end side thereof is held so that the rotating shaft is movable in a longitudinal direction thereof. The conical-type rotor is attached to the free one end side of the rotating shaft. A raw material supply path includes a first material supply path and a second material supply path. The first material supply path communicates with a chamber where the first conical portion is positioned, and the second material supply path communicates with a chamber where the second conical portion is positioned, respectively.

Also, according to a third aspect of the invention, in the refiner according to the first aspect, the conical-type rotor is divided into the first conical portion and the second conical portion. The first conical portion has therein a first hollow portion communicating with the first bottom portion of the first conical portion, and the second conical portion has therein a second hollow portion communicating with the second bottom portion of the second conical portion. The conical-type rotor is formed by abutting the first bottom portion against the second bottom portion to thereby form a hollow portion communicating with the first hollow portion and the second hollow portion in the conical-type rotor.

Also, according to a fourth aspect of the invention, in the refiner according to the first aspect, the conical-type rotor is divided into the first conical portion and the second conical portion. The first bottom portion of the first conical portion is open and includes a first outer peripheral edge and a first inner peripheral edge located inside the first outer peripheral edge, and the second bottom portion of the second conical portion is open and includes a second outer peripheral edge and a second inner peripheral edge located inside the second outer peripheral edge. The conical-type rotor is formed by abutting the first inner peripheral edge against the second inner peripheral edge and abutting the first outer peripheral edge against the second outer peripheral edge, respectively, to thereby form the hollow portion communicating with the first and second bottoms in the conical-type rotor.

Also, according to a fifth aspect of the invention, in the refiner according to the first aspect, the conical-type rotor includes a boss portion abutting against an outer periphery of the rotating shaft, and the first and second conical portions abut against an outer periphery of the boss portion. The first and second conical portions have the same shape. The first bottom portion of the first conical portion is open, and includes the first outer peripheral edge and the first inner peripheral edge located inside the first outer peripheral edge. The second bottom portion of the second conical portion is open, and includes the second outer peripheral edge and the second inner peripheral edge located inside the second outer peripheral edge. The conical-type rotor is formed by abutting the first inner peripheral edge against the second inner peripheral edge and abutting the first outer peripheral edge against the second outer peripheral edge, respectively, to thereby form the hollow portion communicating with the first and second bottoms in the conical-type rotor.

Also, according to a sixth aspect of the invention, there is manufactured a refiner having an apparatus main portion including a driving source, a rotating shaft rotated by the driving source, a beating and dissociating portion, i.e. processing portion, attached to the rotating shaft and having a first portion and a second portion, a first casing having a first material supply path communicating with a chamber where the first portion is positioned and a second casing having a second material supply path communicating with a chamber where the second portion is positioned. It is possible to form a double conical-type rotor having a plurality of conical-type beating and dissociating portions or a double disc-type rotor having a plurality of disc-type beating and dissociating portions. In a method for manufacturing the refiner, the apparatus main portion is used commonly. In case of the refiner having the double conical-type rotor, the conical-type rotor with a substantially cone-shape first conical portion and a substantially cone-shape second conical portion are formed so that bottom portions of the first conical portion and the second conical portion are joined together, a third casing is located between the first casing and the second casing, and the conical-type rotor is housed in the third casing, the first casing and the second casing. In case of the refiner having the double disc-type rotor, the double disc-type rotor is housed in the first casing and the second casing.

DETAILED DESCRIPTION OF PREFERRED EMBODIMENTS

Figure 1:
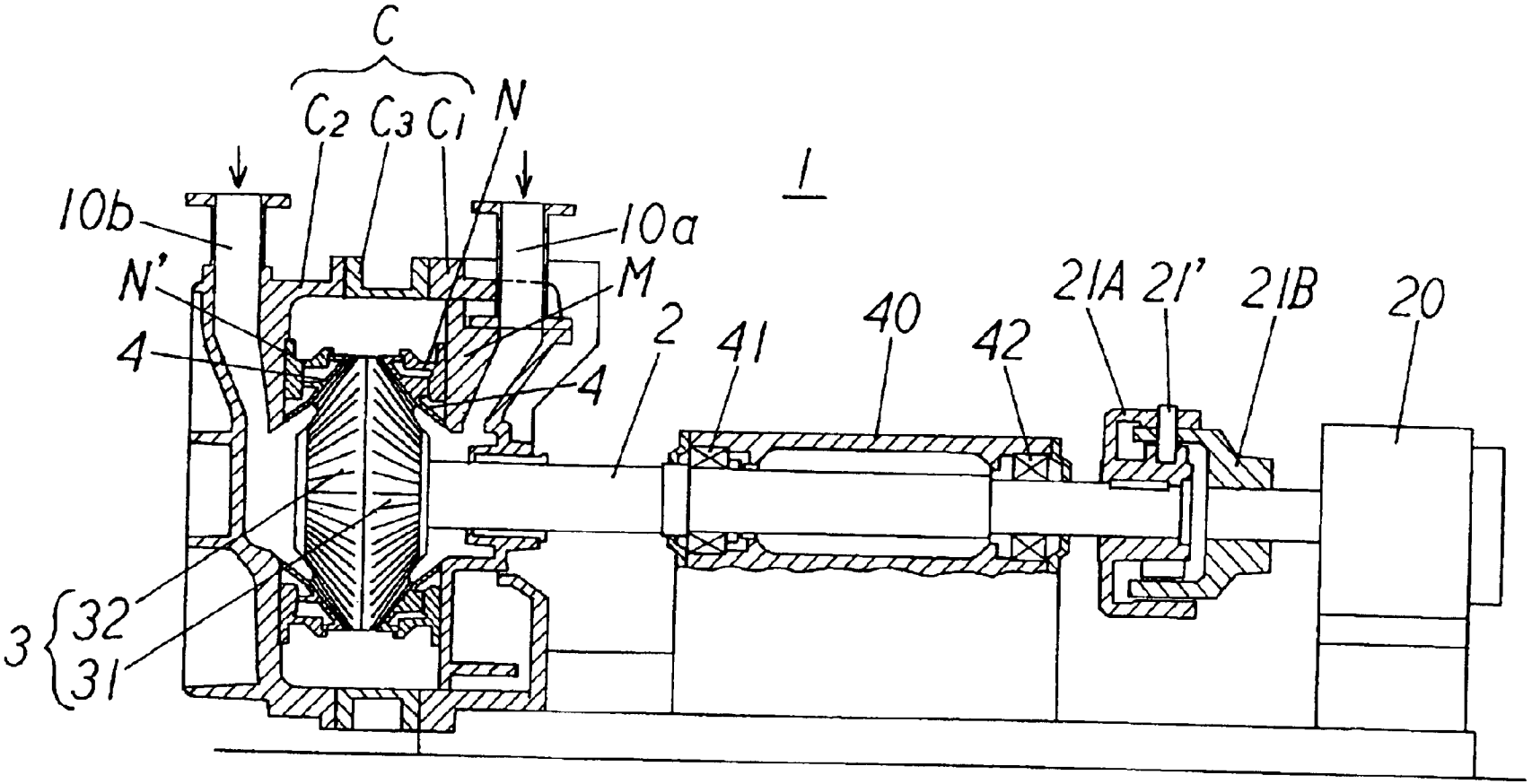
FIG. 1 is a sectional view of a refiner of an embodiment according to the present invention.
Figure 2:
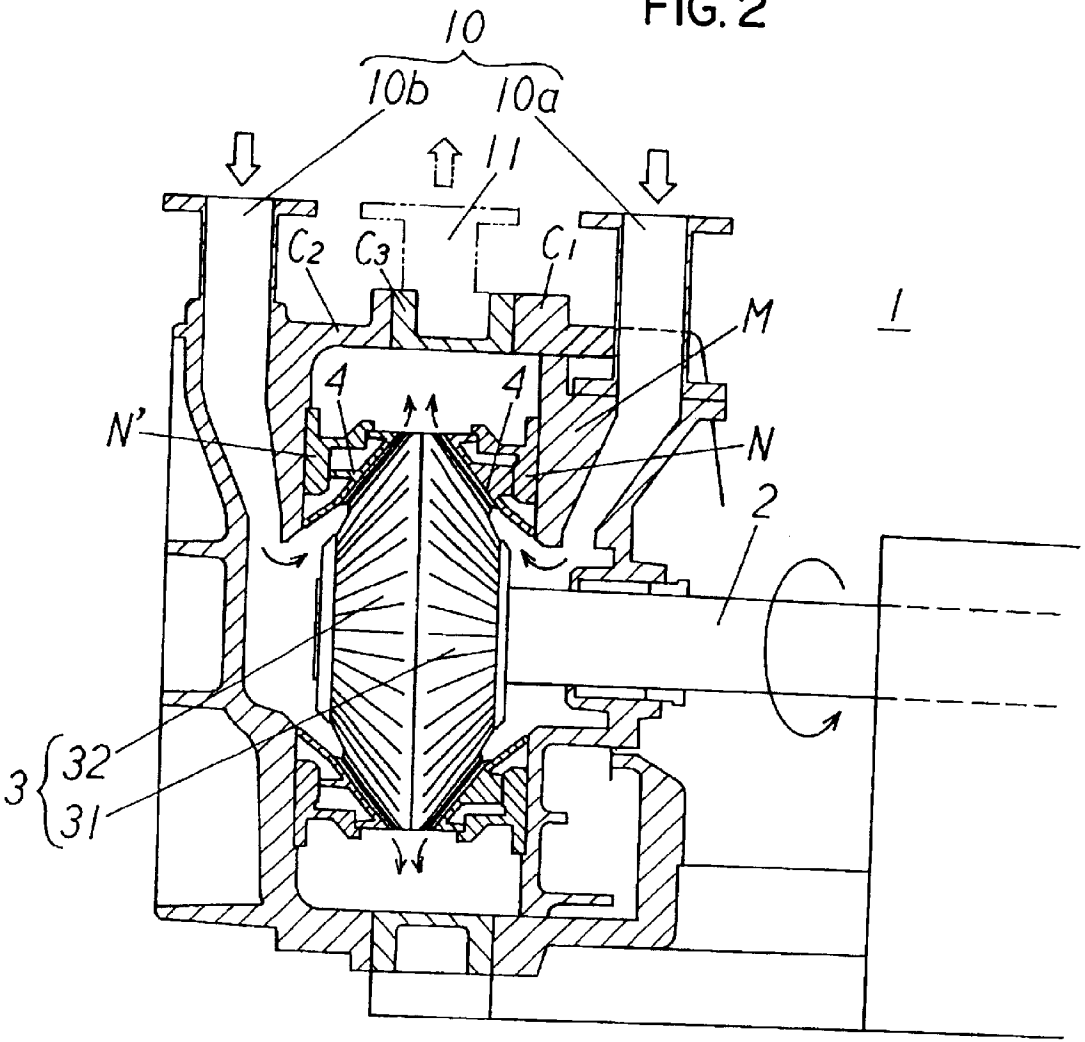
FIG. 2 is a partially enlarged sectional view of FIG. 1.

Refiners according to the present invention will be explained with reference to the accompanying drawings.

In FIGS. 1 through 7, reference numeral 1 represents a refiner, and the refiner 1 includes a conical-type rotor 3 attached to a rotating shaft 2.

Stators 4 are disposed in a casing C to face the conical-type rotor 3. One of the stators 4 is provided through a holder N attached to a sliding panel M extending along an inner wall of the casing C, i.e. a first casing $C_1$, and slidably supporting the rotating shaft 2. The other of the stators 4 is disposed through a holder N' attached to an inner wall of the casing C, i.e. a second casing $C_2$.

Figure 4:
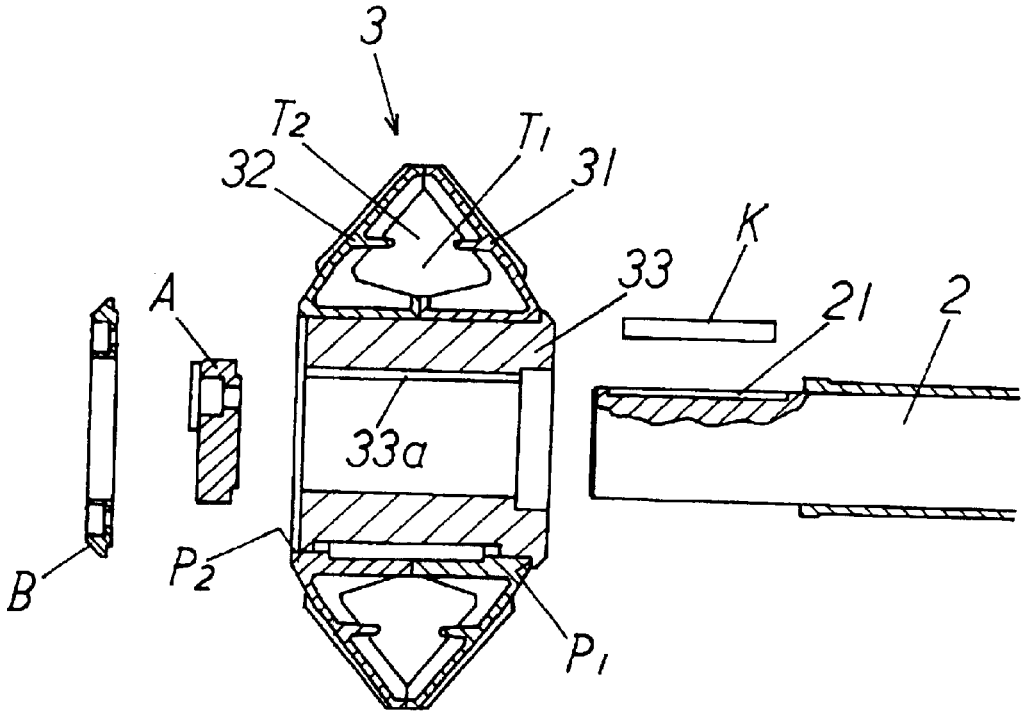
FIG. 4 is an exploded sectional view of an essential part of the invention.
Figure 5:
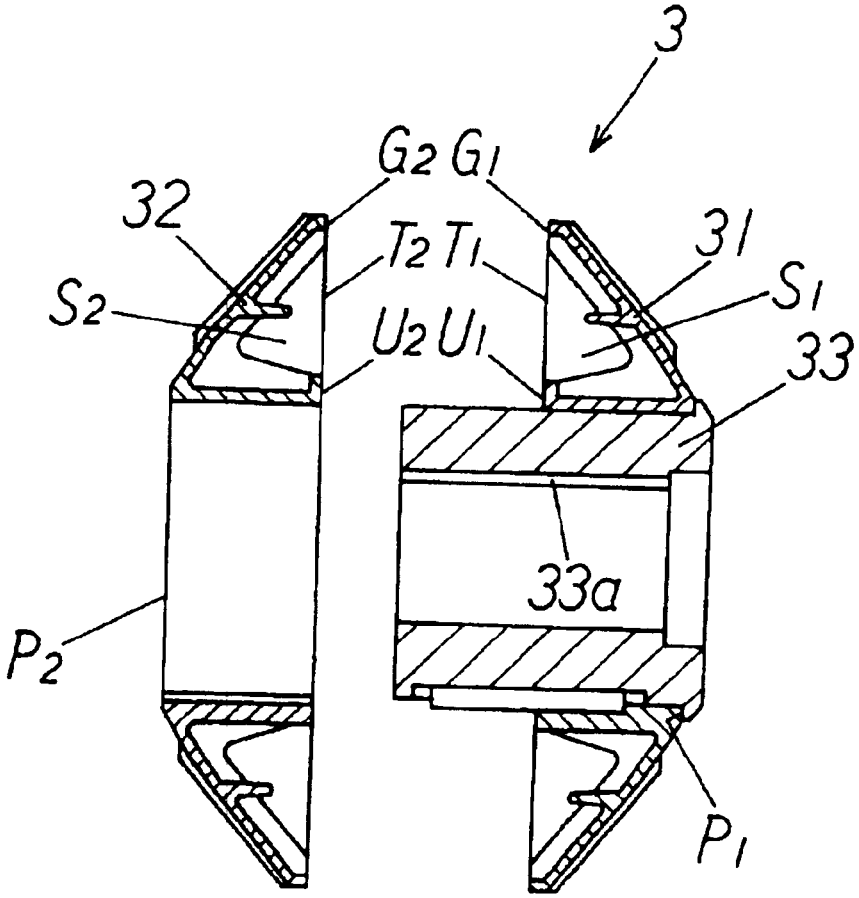
FIG. 5 is an exploded sectional view of a conical-type rotor of FIG. 4.

The conical-type rotor 3 includes a first conical portion 31 having a substantially cone shape and a second conical portion 32 having the substantially cone shape, and takes a shape where a bottom portion $T_1$ of the first conical portion 31 and a bottom portion $T_2$ of the second conical portion 32 are joined together (Refer to FIGS. 4 and 5).

Also, the rotating shaft 2 passes through top portions $P_1$, $P_2$ of the respective first conical portion 31 and the second conical portion 32, and the conical-type rotor 3 is attached to the rotating shaft 2 through a boss 33 of the conical-type rotor 3.

Figure 3:
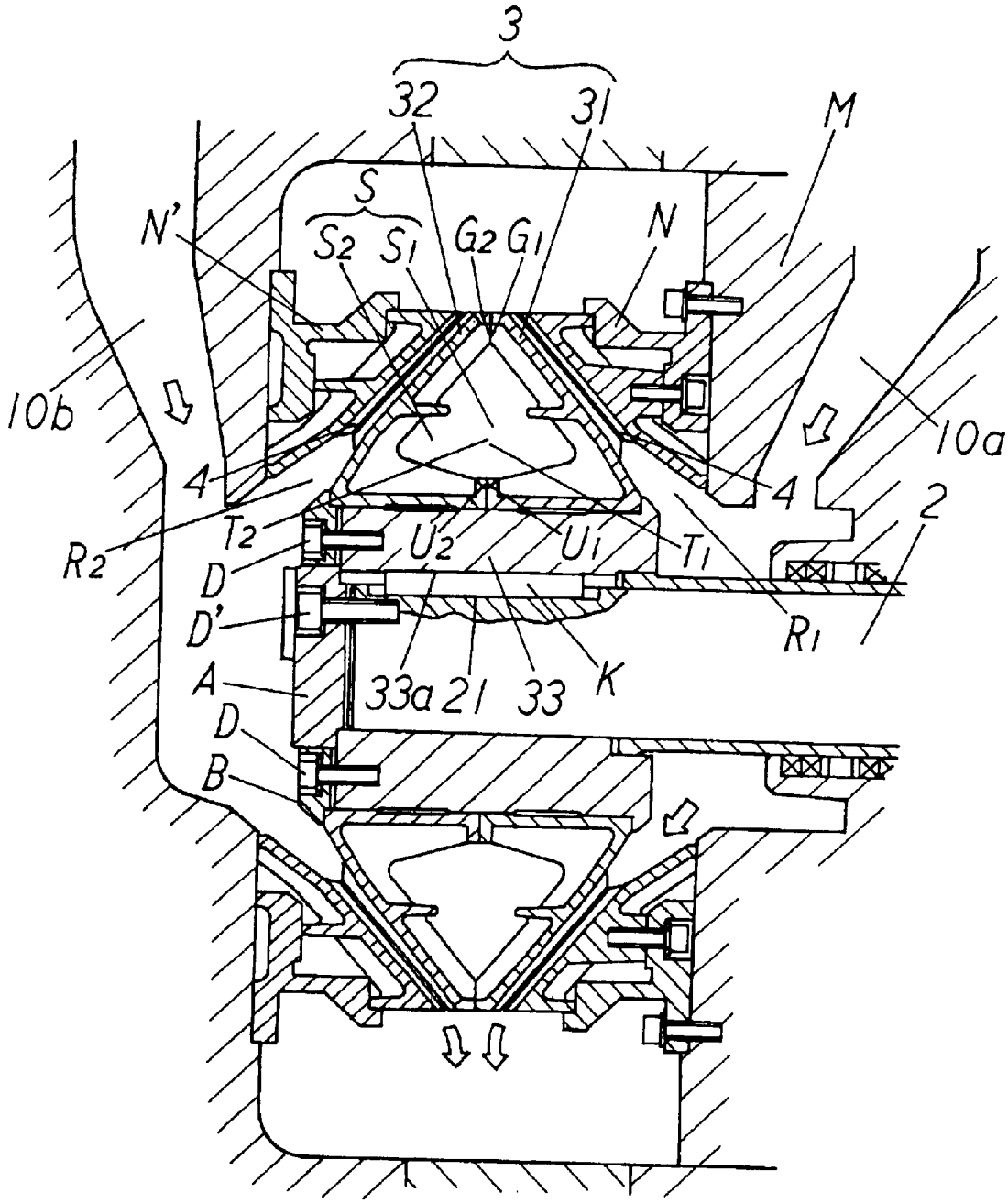
FIG. 3 is a partially enlarged sectional view of FIG. 2.

Incidentally, the shape stating that "the bottom portion $T_1$ of the first conical portion 31 and the bottom portion $T_2$ of the second conical portion 32 are joined together" includes a case wherein the first conical portion 31 and the second conical portion 32 are formed separately, and the bottom portion $T_1$ of the first conical portion 31 and the bottom portion $T_2$ of the second conical portion 32 are joined together, and a case wherein the conical-type rotor 3 is integrally formed in a condition that the bottom portion $T_1$ of the first conical portion 31 and the bottom portion $T_2$ of the second conical portion 32 engage together, as shown in FIGS. 3 through 5.

In case the first conical portion 31 and the second conical portion 32 are divided from the conical-type rotor 3, the first conical portion 31 includes therein a first hollow portion $S_1$ communicating with the first bottom portion $T_1$, and the second conical portion 32 includes therein a second hollow portion $S_2$ communicating with the second bottom portion $T_2$. The conical-type rotor 3 is constituted by abutting the first bottom portion $T_1$ against the second bottom portion $T_2$ to thereby form a hollow portion S communicating with the first hollow portion $S_1$ and the second hollow portion $S_2$ in the conical-type rotor 3.

Also, from another viewpoint, in the conical-type rotor 3, the first bottom portion $T_1$ of the first conical portion 31 is open, and the first bottom portion $T_1$ includes a first outer peripheral edge $G_1$ and a first inner peripheral edge $U_1$ provided inside the first outer peripheral edge $G_1$. The second bottom portion $T_2$ of the second conical portion 32 is open, and the second bottom portion $T_2$ includes a second outer peripheral edge $G_2$ and a second inner peripheral edge $U_2$ provided inside the second outer peripheral edge $G_2$.

Then, the conical-type rotor 3 is constituted by allowing the first inner peripheral edge $U_1$ to abut against the second inner peripheral edge $U_2$ and the first outer peripheral edge $G_1$ to abut against the second outer peripheral edge $G_2$, respectively, to thereby form the hollow portion S communicating with the first bottom portion $T_1$ and the second bottom portion $T_2$ inside the conical-type rotor 3.

As described above, in case the hollow portion S is formed inside the conical-type rotor 3, the conical-type rotor 3 is lightened in weight by the hollow portion S, so that the loads of the driving source 20 and the rotating shaft 2 can be reduced. Also, since the conical-type rotor 3 is divided into the first conical portion 31 and the second conical portion 32, in case the conical-type rotor 3 is damaged, only the first conical portion 31 or the second conical portion 32 may be replaced depending on the damaged position instead of replacing the entire conical-type rotor 3. Thus, the measures against the damage can be easily taken.

Especially, in case the first conical portion 31 and the second conical portion 32 have the same shape, the production cost can be reduced.

Also, as shown in FIGS. 3 and 4, the boss 33 is prevented from being rotated by a key K engaging a key groove 21 provided to the rotating shaft 2 and a key groove 33*a* provided to the boss 33.

In the same manner, the first conical portion 31 and the second conical portion 32 positioned on the boss 33 are prevented from being rotated by a key, not shown, engaging key grooves, not shown, provided to the first conical portion 31, the second conical portion 32 and the boss 33.

As shown in FIG. 3, a bolt D' is tightened against the rotating shaft 2 through a member A and bolts D are tightened against the boss 33 through a member B, respectively, so that the conical-type rotor 3 can be fixed to the rotating shaft 2.

Figure 6:
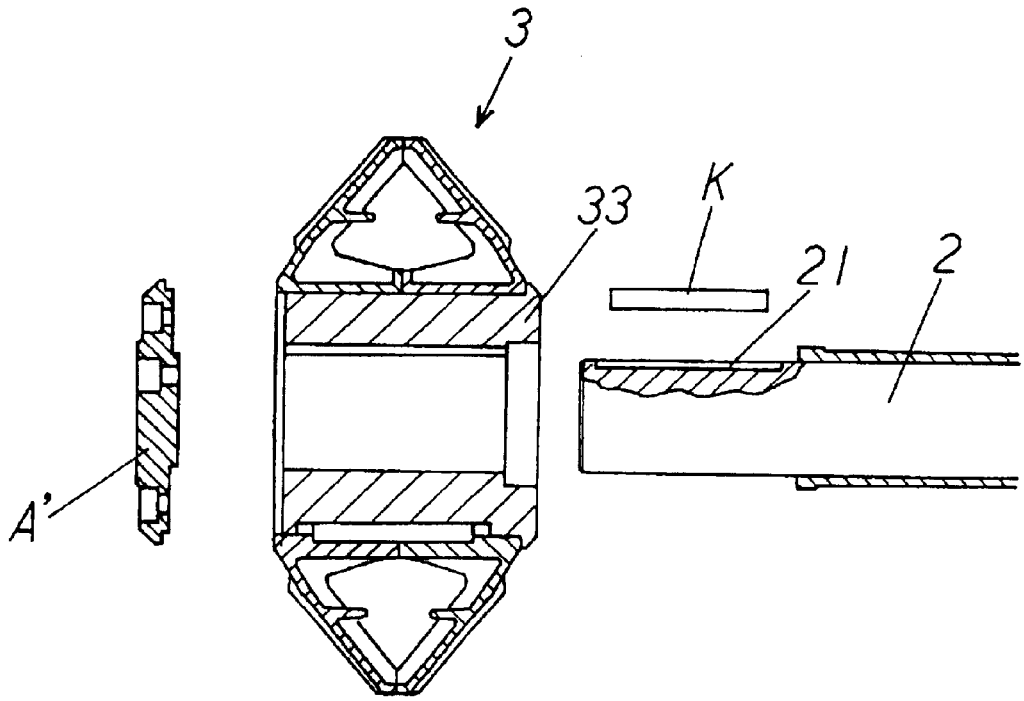
FIG. 6 is an exploded sectional view of an essential part of another embodiment different from the embodiment shown in FIG. 4.

Incidentally, although the members A and B are separately provided, they may be a member A' which is formed integrally, as shown in FIG. 6.

As described above, since the conical-type rotor 3 includes the first conical portion 31 in the substantially cone-shape and the second conical portion 32 in the substantially cone-shape and both conical portions are disposed symmetrically, loads generated when the pulp is beaten and dissociated are applied to the first conical portion 31 and the second conical portion 32 of the conical-type rotor 3 in the opposite directions, respectively, to thereby offset each other and prevent thrusts from being generated. Thus, the mechanism for coping with the thrusts is not required; the energy loss due to the thrusts can be prevented; an area where the pulp is processed can be widened to thereby increase a processing ability; and the entire apparatus can be made compact without making it so large even if the processing ability is increased since the rotating shaft and the like can be commonly used, when compared with the conventional conical-type refiner with a single conical portion.

Also, reference numeral 10 represents a raw material supply path. The raw material supply path 10 includes a first raw material supply path 10*a* and a second raw material supply path 10*b*, and the first raw material supply path 10*a* communicates with a chamber $R_1$ where the first conical portion 31 is positioned and the second raw material supply path 10*b* communicates with a chamber $R_2$ where the second conical portion 32 is positioned, respectively.

Also, the casing C is formed of, generally, a first casing $C_1$, a second casing $C_2$, and a third casing $C_3$. The first casing $C_1$ is provided with the first raw material supply path 10*a*, and the second casing $C_2$ is provided with the second raw material supply path 10*b*, respectively. The third casing $C_3$ is provided between the first casing $C_1$ and the second casing $C_2$. The reference numeral 11 represents an outlet path of the pulp beaten and dissociated by the conical-type rotor 3.

Figure 7:
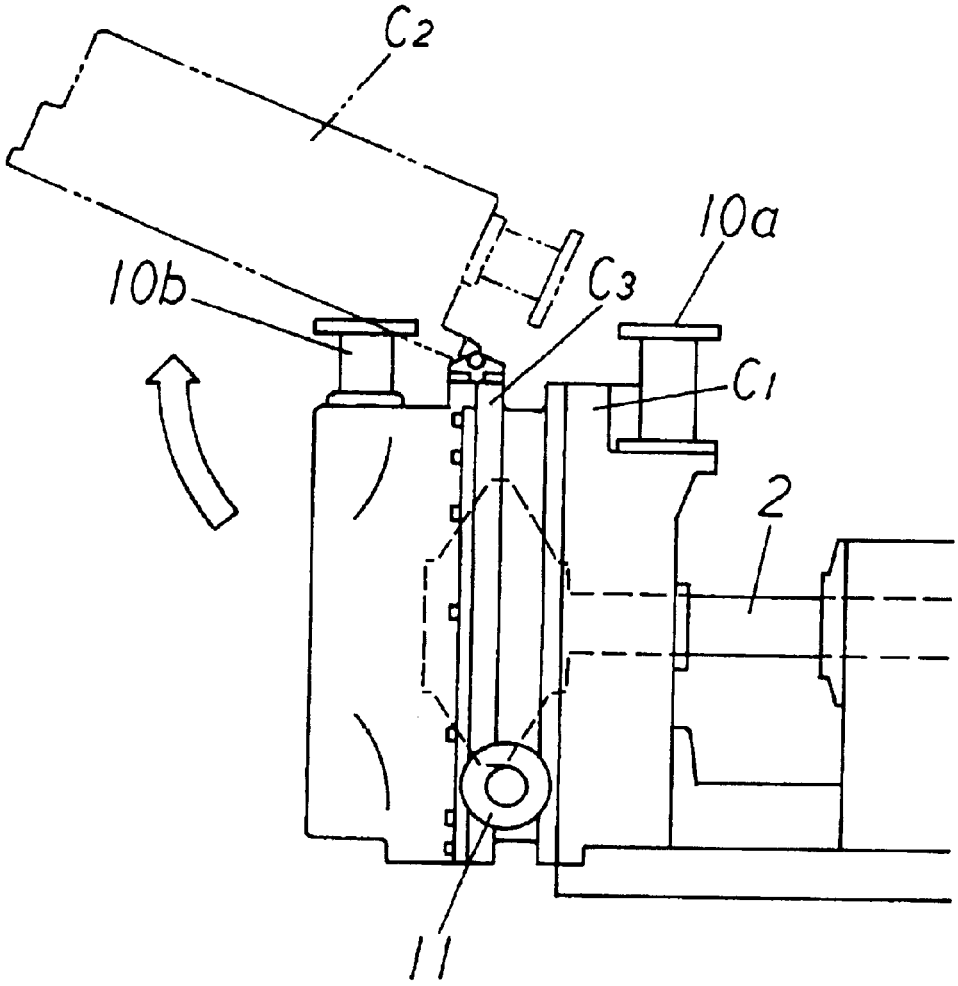
FIG. 7 is a partial plan view showing a rotating state of a second casing of FIG. 1.

Incidentally, the second casing $C_2$ is rotatably attached to the third casing $C_3$ to open or close an opening of the third casing $C_3$, so that the conical-type rotor 3 can be easily attached to the rotating shaft 2, as shown in FIG. 7.

Also, as shown in FIG. 1, reference numeral 20 represents a driving source, such as a motor, and a power of the driving source 20 is transmitted to the rotating shaft 2 through a coupling 21'. One end of the rotating shaft 2 is not supported to be free, and the other end thereof is supported to form a cantilever. Also, the rotating shaft 2 is movably supported in a longitudinal direction thereof. Incidentally, the conical-type rotor 3 is attached to the free one end of the rotating shaft 2.

Also, reference numeral 40 represents a guiding tube having bearings 41, 42 therein. The guiding tube 40 holds the rotating shaft 2 moving in its longitudinal direction, i.e. horizontal direction between one coupling member 21A and the other coupling member 21B of the coupling 21' (for example, refer to FIGS. 1, 5, 6 of Japanese Patent Publication No. 2950780).

As a result, the raw material, i.e. pulp, is supplied parallel to the chamber $R_1$ where the first conical portion 31 is positioned through the first raw material supply path 10*a* and the chamber $R_2$ where the second conical portion 32 is positioned through the second raw material supply path 10*b*. The raw material is beaten and dissociated between the conical-type rotor 3 and the stators 4, and is discharged outside the casing C through the outlet path 11.

Incidentally, since the rotating shaft 2 is movably held in the longitudinal direction thereof, when the pulp is beaten and dissociated, the rotating shaft 2 is automatically moved by the balance of the loads applied to the first conical portion 31 and the second conical portion 32 of the conical rotor 3. Therefore, the thrust load is not generated from one side, as in the conventional single conical-type refiner with a single conical portion, so that the rotating shaft 2 is prevented from being damaged and the structure of the bearing becomes simple.

Also, in case a double conical-type refiner having a plurality of conical portions as described above and a double disc-type refiner having a plurality of disc-type rotors are manufactured, the apparatus main portion is formed to be used commonly, so that the production cost thereof can be reduced.

Here, "the apparatus main portion" includes the driving source 20, the rotating shaft 2 driven by the driving source 20, the beating and dissociation portion attached to the rotating shaft 2 and having a first beating and dissociating portion and a second beating and dissociating portion, the first casing $C_1$ having the first raw material supply path 10*a* communicating with the chamber $R_1$ where the first beating and dissociating portion is positioned, and the second casing $C_2$ having the second raw material supply path 10*b* communicating with the chamber $R_2$ where the second beating and dissociating portion is positioned.

Figure 8:
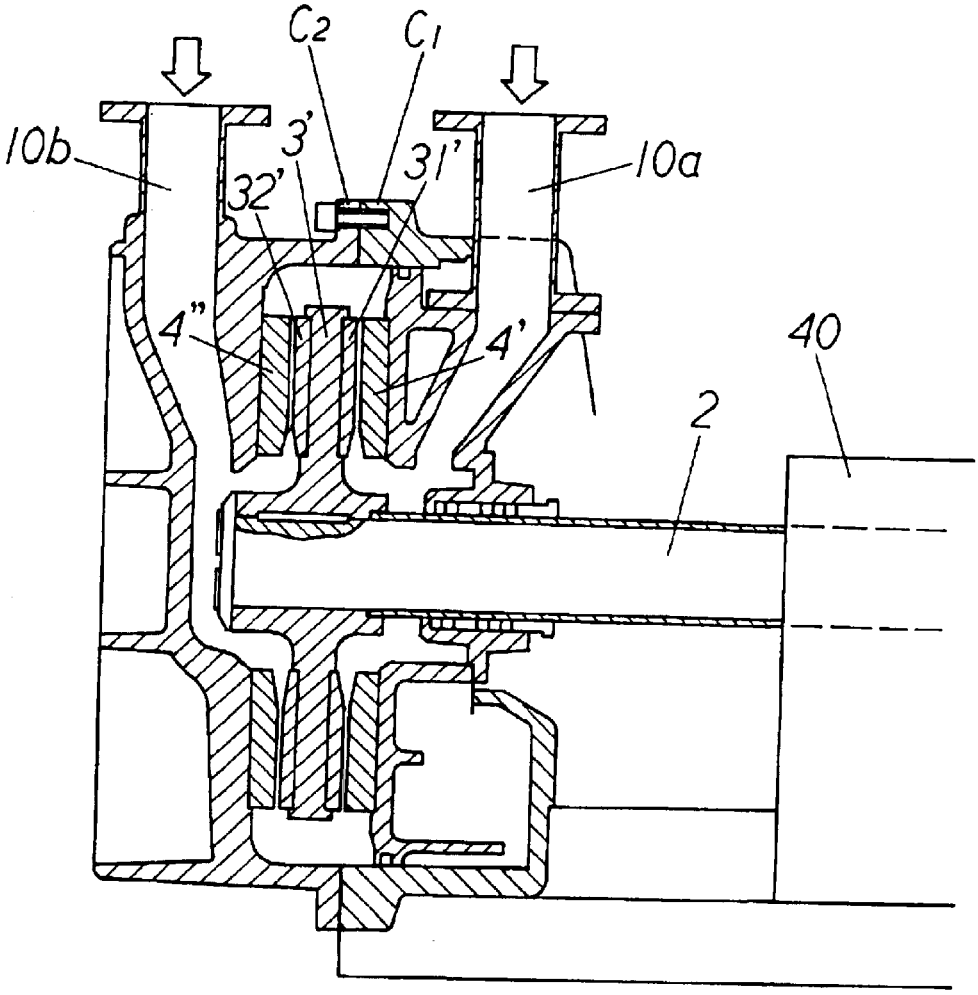
FIG. 8 is a sectional view of a refiner having a double disc-type rotor, wherein an apparatus main portion of the refiner shown in FIG. 1 is commonly used.

The above-described beating and dissociating portion corresponds to the rotor 3 having a plurality of the conical portions in case of the double conical-type refiner, and corresponds to the double disc-type rotor 3' in case of the double disc-type refiner as shown in FIG. 8.

More specifically, in case of the refiner 1 having the conical-type rotor 3, as described above, the conical-type rotor 3 includes the substantially cone-shape first conical portion 31 and the substantially cone-shape second conical portion 32, and the bottom portion $T_1$ of the first conical portion 31 and the bottom portion $T_2$ of the second conical portion 32 are joined together.

The conical-type rotor 3 is housed in the first casing $C_1$, the second casing $C_2$ and the third casing $C_3$. The stators 4 are disposed to face the first conical portion 31 and the second conical portion 32, respectively (Refer to FIG. 3).

Also, in case of the double disc-type refiner 1, as shown in FIG. 8, the double disc-type rotor 3' having a plurality of disc-type rotors is housed in the first casing $C_1$ and the second casing $C_2$.

Then, the first stator 4' for the double disc-type rotor may be disposed to an inner wall of the first casing $C_1$ to face the first beating and dissociating portion 31' of the double disc-type rotor 3', and the second stator 4' for the double disc-type rotor may be disposed to an inner wall of the second casing $C_2$ to face the second beating portion 32' of the double disc-type rotor 3', respectively.

According to the first aspect of the refiner of the invention, since the conical-type rotor includes a substantially cone-shape first conical portion and a substantially cone-shape second conical portion, the loads generated when the pulp is beaten and decomposed are applied to the first conical portion and the second conical portion of the conical-type rotor in the opposite directions, respectively, to thereby offset each other and prevent thrusts from being generated. Thus, the mechanism for coping with the thrusts is not required; the energy loss due to the thrusts can be prevented; the area where the pulp is treated can be widened to thereby increase a processing ability; and when compared with the conventional conical-type refiner with a single conical portion, the entire apparatus can be made compact even if its processing ability is increased since the rotating shaft can be commonly used.

Also, according to the second aspect of the refiner of the invention, in addition to the effects of the first aspect of the invention, the raw material is supplied parallel to the chamber where the first conical portion is positioned through the first raw material supply path and the chamber where the second conical portion is positioned through the second raw material supply path, respectively. Since the rotating shaft is held to be moved in the longitudinal direction thereof, when the pulp is processed, the rotating shaft is automatically moved by the balance of the loads applied to the first conical portion and the second conical portion of the conical rotor. Therefore, the thrust load is not generated from one side, as in the conventional conical-type refiner with a single conical portion, so that the rotating shaft is prevented from being damaged and the structure of the bearing can be made simple.

Also, according to the third and fourth aspects of the refiner of the invention, in addition to the effects obtained in the first aspect, since the hollow portion is formed in the conical-type rotor to communicate with a first hollow portion of the first conical portion and a second hollow portion of the second conical portion, the conical-type rotor is lightened in weight by the portion forming the hollow portion. Thus, the loads for the driving source and the rotating shaft can be reduced. Also, since the conical-type rotor is formed of the first conical portion and the second conical portion, in case the conical-type rotor is damaged, only the first conical portion or the second conical portion may be replaced depending on the damaged position instead of replacing the entire conical-type rotor. Thus, the measures to the damage can be easily taken.

Also, according to the fifth aspect of the refiner of the invention, in addition to the effects obtained in the first and third or fourth aspects, since the first conical portion and the second conical portion have the same shapes, its production cost can be reduced.

Also, according to a method for manufacturing the refiner of the invention, in addition to the effects obtained in the first aspect of the invention, in case the double conical-type refiner having a plurality of conical portions or the double disc-type refiner having two disc-type rotors are manufactured, the main portion of the apparatus is formed to be used commonly, so that the production cost thereof can be reduced.

While the invention has been explained with reference to the specific embodiments of the invention, the explanation is illustrative and the invention is limited only by the appended claims.

What is claimed is:

1. A refiner comprising:

a driving source, a rotating shaft connected to the driving source and having a free end at one side and a supporting portion at the other side so that the rotating shaft is movably supported in a longitudinal direction thereof at the supporting portion, a conical rotor attached to the free end of the rotating shaft and including a substantially cone-shape first conical portion having first top and bottom portions, and a substantially cone-shape second conical portion having second top and bottom portions, said first and second bottom portions of the first and second conical portions being joined together, said rotating shaft passing through the first and second top portions of the first and second conical portions to thereby attach the conical rotor to rotating shaft, a casing for receiving the conical rotor, and a plurality of stators disposed in the casing to face the conical rotor.

2. A refiner according to claim 1, wherein said casing includes a raw material supply path having a first raw material supply path communicating with a chamber where the first conical portion is positioned, and a second raw material supply path communicating with a chamber where the second conical portion is positioned.

3. A refiner according to claim 1, wherein said first conical portion and the second conical portion are divided, said first conical portion having therein a first hollow portion communicating with the first bottom portion, said second conical portion having therein a second hollow portion communicating with the second bottom portion, said first and second bottom portions abutting against each other to form the conical rotor so that the conical rotor has a hollow portion therein communicating with the first hollow portion and the second hollow portion.

4. A refiner according to claim 1, wherein said first bottom portion is open and has a first outer peripheral edge and a first inner peripheral edge located inside the first outer peripheral edge, and said second bottom portion is open and has a second outer peripheral edge and a second inner peripheral edge located inside the second outer peripheral edge, said first and second inner peripheral edges and said first and second outer peripheral edges respectively abutting against each other to form the conical rotor so that a hollow portion communicating with the first and second bottom portions is formed in the conical rotor.

5. A refiner according to claim 4, wherein said conical rotor includes a boss portion abutting against an outer periphery of the rotating shaft, and the first and second conical portions abut against an outer periphery of the boss portion and have same shapes.

* * * * *